US010680316B2

(12) United States Patent
Lindenmeier et al.

(10) Patent No.: US 10,680,316 B2
(45) Date of Patent: Jun. 9, 2020

(54) ANTENNA ARRAY

(71) Applicant: FUBA AUTOMOTIVE ELECTRONICS GMBH, Bad Salzdetfurth (DE)

(72) Inventors: Stefan Lindenmeier, Gauting-Buchendorf (DE); Heinz Lindenmeier, Planegg (DE)

(73) Assignee: FUBA Automotive Electronics GmbH (DE)

( * ) Notice: Subject to any disclaimer, the term of this patent is extended or adjusted under 35 U.S.C. 154(b) by 36 days.

(21) Appl. No.: 16/099,282

(22) PCT Filed: May 3, 2017

(86) PCT No.: PCT/EP2017/060524
§ 371 (c)(1),
(2) Date: Nov. 6, 2018

(87) PCT Pub. No.: WO2017/191183
PCT Pub. Date: Nov. 9, 2017

(65) Prior Publication Data

US 2019/0214710 A1 Jul. 11, 2019

(30) Foreign Application Priority Data

May 6, 2016 (DE) ..... 10 2016 005 556

(51) Int. Cl.
*H01Q 1/32* (2006.01)
*H01Q 1/42* (2006.01)
*H01Q 7/00* (2006.01)

(52) U.S. Cl.
CPC ..... *H01Q 1/325* (2013.01); *H01Q 1/3275* (2013.01); *H01Q 1/42* (2013.01); *H01Q 7/00* (2013.01)

(58) Field of Classification Search
CPC ..... H01Q 1/32; H01Q 1/42; H01Q 7/00
USPC ..... 343/741
See application file for complete search history.

(56) References Cited

U.S. PATENT DOCUMENTS

2008/0122708 A1* 5/2008 Lindackers ..... H01Q 1/1214 343/713
2010/0141534 A1* 6/2010 Sato ..... H01Q 1/12 343/702
2014/0285387 A1 9/2014 Lindenmeier et al.

FOREIGN PATENT DOCUMENTS

DE 102013005001 A1 9/2014
EP 2424036 A2 2/2012

OTHER PUBLICATIONS

English Translation of International Search Report for International Application No. PCT/EP2017/060524 dated Jul. 26, 2017, 2 pages.
English Translation of Written Opinion for International Application No. PCT/EP2017/060524 dated Jul. 26, 2017, 5 pages.

* cited by examiner

*Primary Examiner* — Andrea Lindgren Baltzell
(74) *Attorney, Agent, or Firm* — Dickinson Wright PLLC

(57) ABSTRACT

In an antenna array for receiving circularly polarized satellite radio signals, an antenna structure that includes a closed-loop radiator is placed in a plastic protective antenna cover and is secured therein in an interlocking manner.

16 Claims, 7 Drawing Sheets

Fig. 1

ANTENNA ARRAY

CROSS-REFERENCES TO RELATED APPLICATIONS

This patent application is a 371 of International Application No. PCT/EP2017/060524, filed May 3, 2017 which claims the priority of German Application No. 102016005556.1, filed May 6, 2016, each of which are incorporated herein by reference in their entirety.

The invention relates to an antenna arrangement for the reception of circularly polarized satellite radio signals in which an antenna structure having a loop radiator is arranged in a protective antenna cover composed of plastic.

Such a reception takes place in the example of SDARS satellite radio at a frequency of approximately 2.33 GHz having the free space wavelength $\lambda$=12.8 cm in two adjacent frequency bands each having a bandwidth of 4 MHz at a spacing of the center frequencies of 8 MHz. The signals are irradiated from different satellites with an electromagnetic wave circularly polarized in one direction. Similar satellite radio systems are currently in planning. Circularly polarized antennas in the corresponding rotational direction are accordingly used for the reception. The satellites of the global positioning system (GPS) likewise radiate waves circularly polarized in one direction at the frequency of approximately 1575 MHz so that said antenna shapes can generally inter alia also be designed for this service.

Such antennas are preferably used on a vehicle roof for the mobile reception of circularly polarized satellite signals of the satellite radio services SDARS or XM or e.g. the GPS navigation system in vehicles. The metal vehicle roof here frequently serves as an expanded electrically conductive base surface for such antennas. Provision is likewise made to accommodate an antenna for the reception of circularly polarized satellite radio signals beneath a shell-shaped protective antenna cover composed of dielectric plastic. The opening side of the shell is here covered by an electrically conductive base plate that is mechanically connected to the protective antenna cover and that can be positioned with a substantially horizontal orientation on the outer skin of a motor vehicle.

Figure 1:
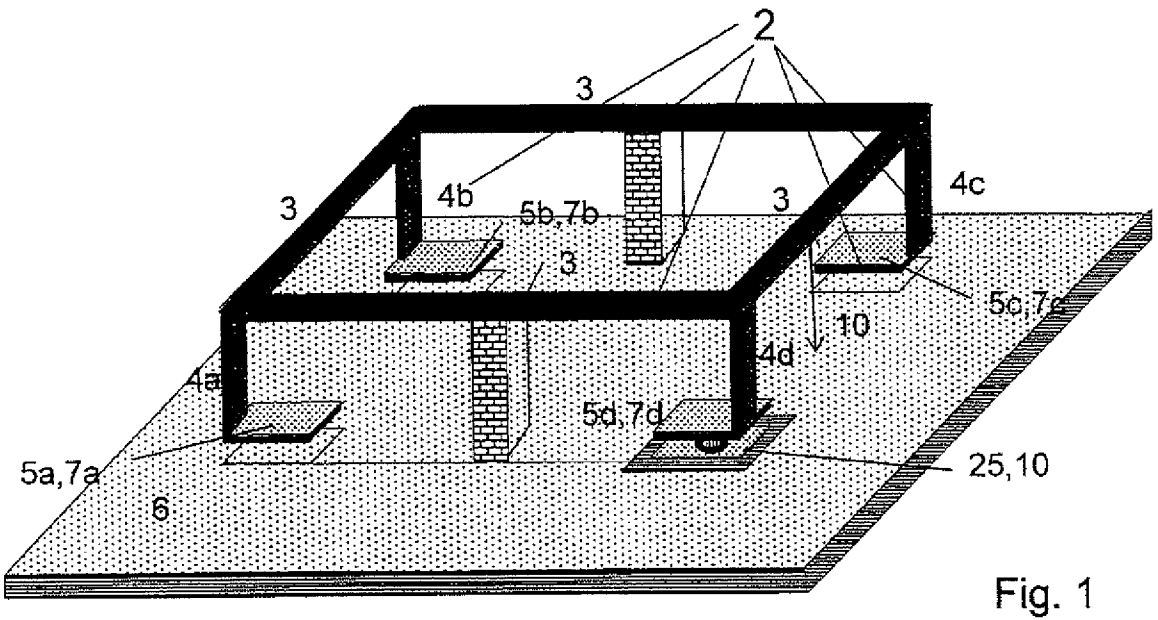

Such a loop radiator is known from DE 10 2009 040 910 and is shown as prior art in FIG. 1. The loop radiator shown is cut from sheet metal and is subsequently brought into the shape shown by bending. The arrangement of such an antenna beneath a shell-shaped protective antenna cover composed of plastic material is known from DE 10 2013 005 001. The shell-shaped protective antenna cover serves as protection of the antenna both from moisture and from electrostatic discharge (ESD protection). The satellite antenna described there is of loop design and is fastened to the base plate that terminates the opening of the protective antenna cover. A similar kind of fastening on the base plate is typical on the use of patch antennas as circularly polarized satellite antennas.

The known satellite antenna shown in FIG. 1 comprises a loop radiator 1 that is formed by a closed loop 3 in particular arranged at a spacing $h<\lambda/10$ marked by reference numeral 10 and extending in parallel with a conductive base plate 6 and that has linear, substantially vertical radiators 4*a*-4*d* connected in distributed form to the periphery of the loop radiator 1 and extending toward the conductive base plate 6. At least one of the linear radiators is here connected at its lower end via a capacitor 5*a*-5*c* to the electrically conductive base plate 6 and another substantially vertical radiator 4*d* is connected via a capacitor 5*d* to an antenna connector 5*e*.

What is decisive for the acceptance of the technology of an antenna for vehicles is, in addition to the functionality of the antenna, above all the economic effort that is associated both with the manufacture of the antenna and also with its implementation on the vehicle.

Due to the very tight tolerances in directional radiation patterns of satellite antennas, the tolerances for the manufacture of such antennas are extremely small. The observation of not only the mechanical dimensions, but also of the dielectric properties of the antenna body is equally a problem with circularly polarized antennas that work in accordance with a different principle of action such as patch antennas. In particular the observation of the mechanical dimensions is of special importance in the present loop radiator.

The storage of the loop radiator cut from sheet metal and subsequently bent as a mass produced product in mass production is also problematic. A storage of the sheet metal structure maintaining its shape is extremely complex and/or expensive and a harmful deformation of the structure by handing can only be avoided with great difficulty due to the extremely tight tolerances.

These demands on the accuracy naturally result in increased manufacturing costs for the antennas.

The object is therefore associated with the present invention of designing an antenna for the reception of circularly polarized satellite radio signals that enables a simpler implementation on the vehicle with a high functional reliability and with a small economic effort.

This object is satisfied by the features of claim 1.

Advantageous embodiments of the invention are described in the dependent claims and in the description.

Individual features of the invention can be:

- the protective antenna cover 1*a* comprises a shell that is partly hollow in the interior, that is composed of dielectric plastic and that is optionally mechanically connected at its opening side of the shell to an electrically conductive base plate;
- the antenna structure 2 is introduced in a shape matched manner into the protective antenna cover 1*a* before the establishing of the mechanical connection between the electrically conductive base surface 6 and the protective antenna cover 1*a*; and
- the introduction of the antenna structure 2 into the protective antenna cover 1*a* is of exact shape in a manner such that, on the establishing of the mechanical connection between the electrically conductive base surface 6 and the protective antenna cover 1*a*, the spacing 11 for forming the respectively required capacitance between the capacitive flat electrodes 5*a*-5*d* and the electrically conductive base surface 6 is exactly observed.

An inventive idea inter alia comprises introducing the slightly deformable antenna structure 2 of sheet material into the protective antenna cover 1*a* correspondingly shaped in its interior in an exact shape and in particular with temporal stability. The particular advantage of the invention is given in that the dimensional stability can easily be observed due to the shape of the protective antenna cover 1*a* pressed into plastic. The properties of modern plastics in particular also have long term stability under extreme weather conditions. A fixed connection between the protective antenna cover 1*a* and a conductive base surface 6 can always be established in accordance with the given prior art. The dimensional stability required for the function of the loop radiator 1 can thus be established by a correspondingly shaped plastic body in the interior of the protective antenna cover 1*a* which the antenna structure 2 nestles up to in a clamping manner, e.g. under a preload. At least one latch element, for example a latch nose 26 (FIG. 4) can furthermore be provided in the plastic of the protective antenna cover 1*a* to hold the antenna structure 2.

With a loop radiator 1 in accordance with the prior art in FIG. 1, the observation of the capacitance values by the electrodes 5*a*, 5*b*, 5*c*, 5*d* is of great importance with respect to the antenna impedance and to the radiation pattern. The ensuring of the correct spacing 11 (see FIG. 3) required for this purpose of the capacitive flat electrodes 7*a*-7*d* from the conductive base surface 6 or from the counter-electrode 25 forming the antenna connector 10 is given in a simple manner by the dimensional stability of the protective antenna cover 1*a*. The particular advantage of the invention here results in a manner such that, in addition to the exact observation of the distance 11 required for the capacitor 5*a*-5*d* between the capacitive flat electrodes 7*a*-7*d* and the electrically conductive base surface 6, the connection of the antenna structure 2 to the antenna connector 10 is also established capacitively, i.e. without a solder connection, when the protective antenna cover 1*a* is mechanically connected to the conductive base surface 6. This capacitive implementation of the connection of the antenna structure 2 to the more advanced circuit on the base surface 6—that is implemented by a circuit board as a rule—in particular effects a substantial cost advantage for mass production.

In an advantageous embodiment of the invention, the antenna structure 2 is pushed into the protective antenna cover 1*a* via a rail system of guide furrows or grooves 9 that are open toward the opening of the protective antenna cover 1*a*. On a bending downward of the radial sheet metal strips 4*a*-4*d* by the bend angle of the vertical radiators 15 of approximately 90° with respect to the plane of the loop structure 3, an overhang 12 naturally arises that approximately corresponds to the thickness of the sheet metal.

To guide the vertical radiators 4*a*-4*b*, a plurality of vertical inner surfaces can be designed in the protective antenna cover 1*a* for this purpose on the plastic body of the protective antenna cover 1*a* that have straight-line vertical guide grooves 9 that extend exactly in parallel with one another so that a rail system up to the opening margin 11 of the protective antenna cover 1*a* is formed over the height of the antenna structure 2, with the positions of the guide furrows 9 being adapted to the dimensions of the loop structure 3 and with their width being adapted to the width of the sheet metal strips which form the vertical radiators 4*a* 4*d* and by which the vertical radiators 4*a*-4*d* are guided with an exact shape on the insertion of the antenna structure 2.

The capacitors 5*a*, 5*b*, 5*c*, 5*d* are each formed by a capacitive flat electrode 7*a*-7*d* and are disposed opposite a flat counter-electrode in the plane of the base plate 6 respectively parallel thereto. The capacitance value of the capacitors 5*a*, 5*b*, 5*c*, 5*d* is co-determined by the spacing 11 in each case.

In a loop radiator 1 in accordance with the prior art in FIG. 1, the observance of the capacitance values 5*a*, 5*b*, 5*c*, 5*d* by the capacitive flat electrodes 7*a*-7*d* is of great importance with respect to the antenna impedance and the radiation pattern of the satellite antenna. The ensuring of the correct spacing 11 (see FIG. 3) required for this purpose of the capacitive flat electrodes 7*a*-7*d* from the conductive base surface 6 or from the counter-electrode 25 forming the antenna connector 10 is given in a simple manner in accordance with the invention by the dimensional stability of the protective antenna cover 1*a*. For the capacitive connection of a vertical radiator 4*d* at its lower end to the antenna connector 10 in the plane of the base plate 6, a flat counter-electrode 25 is formed that is electrically insulated therefrom.

To ensure the error-free mold removal on the pressing of the shell-shaped cover, all the flat parts disposed in the interior of the shell-shaped protective antenna cover 1*a* and all the flat parts disposed on the outer surface of the shell-shaped protective antenna cover 1*a* should adopt an angle toward the horizontal reference plane of no more than 89.5% as the mold removal slope.

To generate a preload, the bend angle of the vertical radiators 15 established from the prefabrication can be set up to a few annular degrees smaller than 90°, that is at 87° for example, with respect to the plane of the loop structure 3. By inserting the antenna structure 2 into the rail system formed by the guide grooves 9 in the interior of the protective antenna cover 1*a*, the vertical radiators are pressed into the desired angular position of 90° with respect to the plane of the loop structure 3.

It is furthermore disclosed that the electrode angle 14 established from the prefabrication for generating a preload with respect to the electrically conductive base surface 6 can be set up to a few angular degrees smaller than 90°, that is likewise at 87°, for example. To adjust the electrode angle 14 to 90°, an adjustment punch 16 having two abutments is shaped in the interior of the protective antenna cover 1*a* for this purpose, of which the upper abutment 17 holds down the loop structure 3 and the lower abutment 18 presses down the capacitive flat electrode 7*a*-7*d* in a manner such that its parallelism with respect to the electrically conductive base surface 6 is set when the antenna structure 2 is completely inserted into the interior of the protective antenna cover 1*a*. In addition, the required spacing 11 is exactly observed via the spacing between the lower abutment 17 of the adjustment punch 16 and its end seated on the conductive base surface 6. The abutments can naturally also be formed in a different manner in the interior of the protective antenna cover 1*a*.

In accordance with the invention, it is ensured in a particularly economic manner that the antenna structure 2 has the correct shape and thus holds the electrical data to be expected in the long term after the insertion into the protective antenna cover 1*a*. Modern plastics have an extremely small coefficient of thermal expansion of, for example, $65*10^{-6}1/°$ C. The required consistency of the capacitors 5*a*-5*d* is sufficiently given on this basis.

Figure 2:
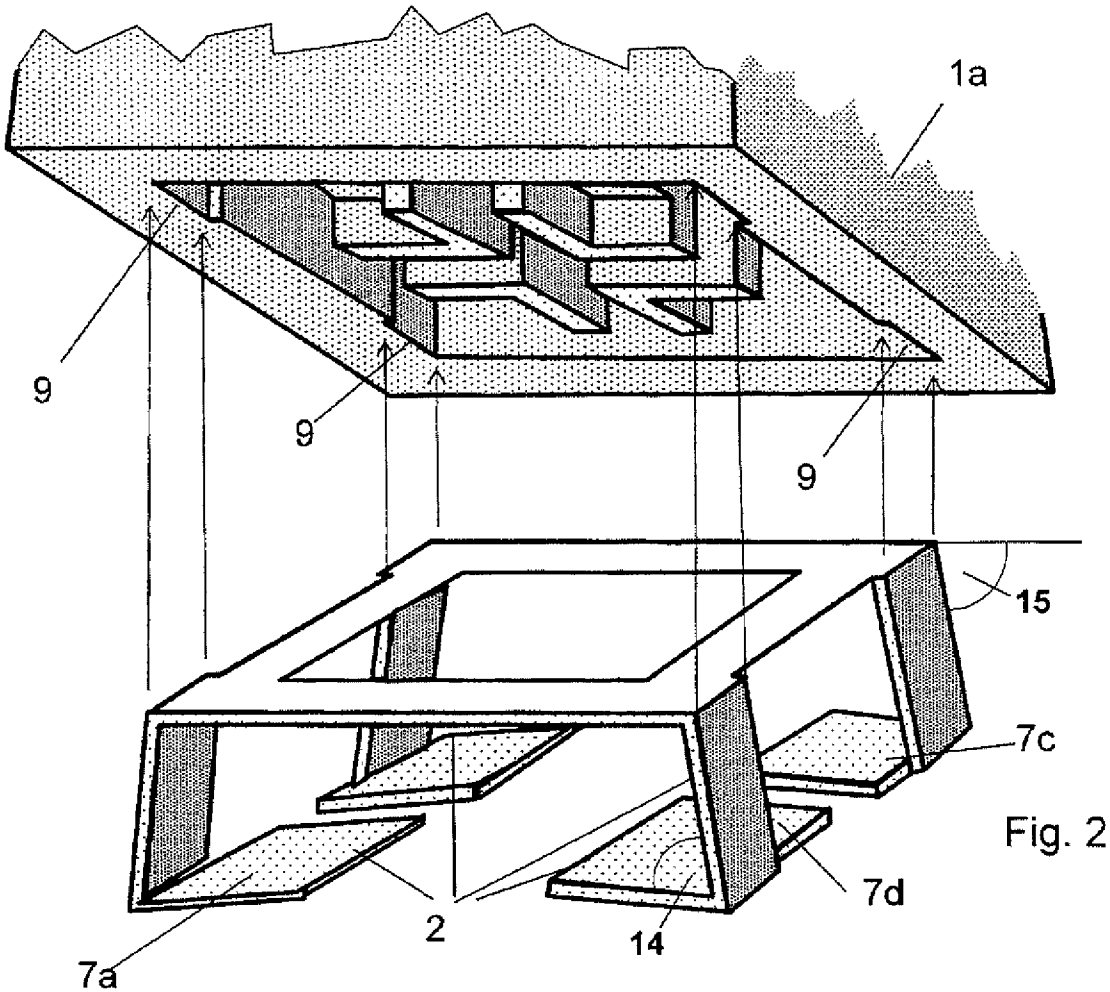
Figure 3:
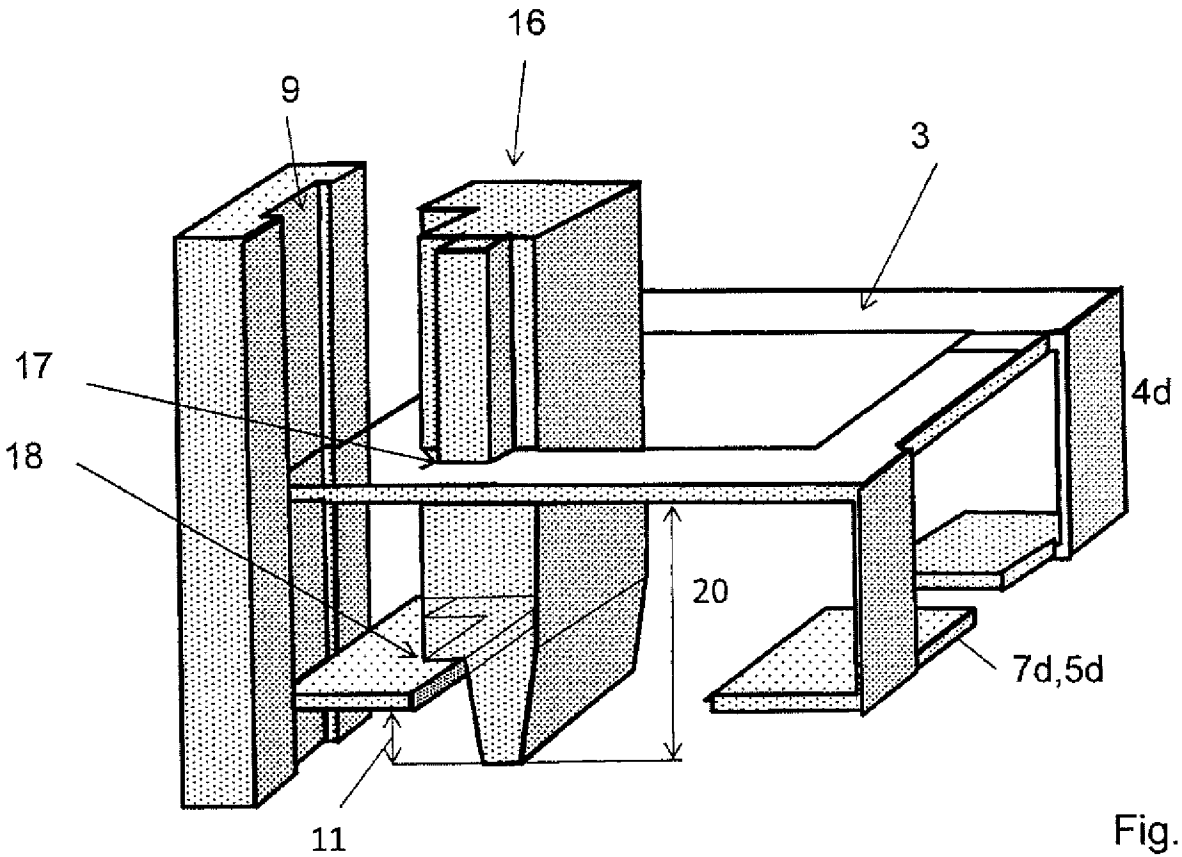
Figure 4:
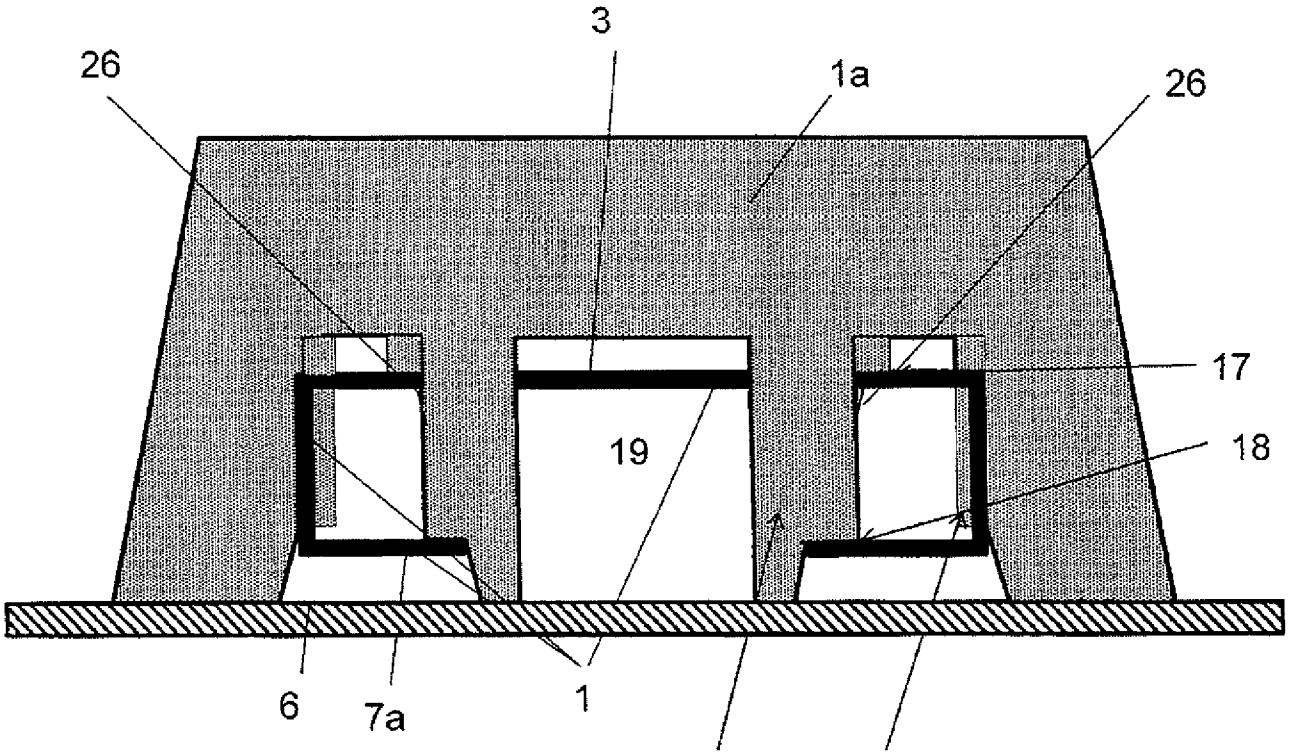
Figure 5:
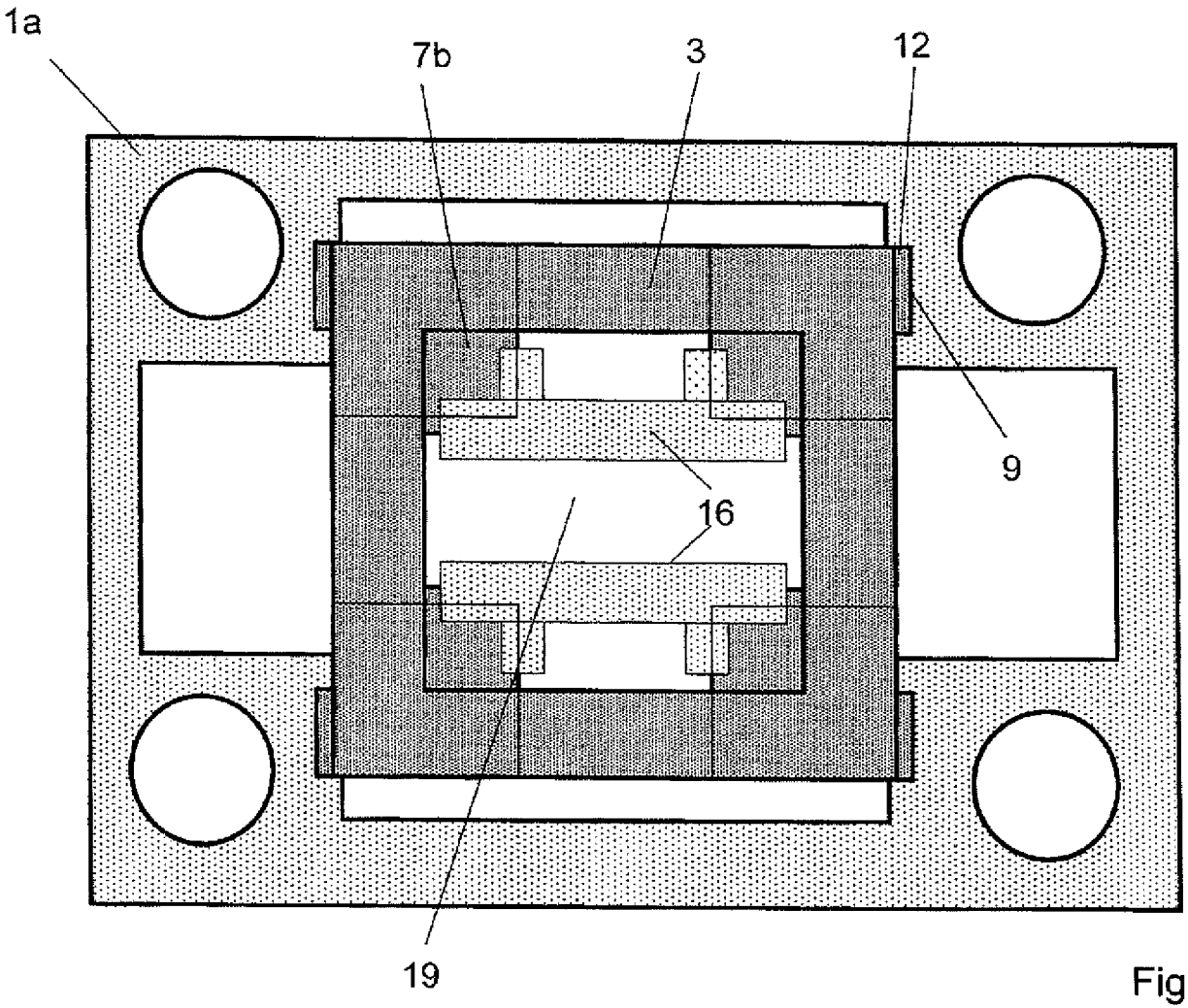

The invention will be further explained in more detail in the following with reference to embodiments. The associated Figures show in detail:

FIG. 1: loop radiators 1 in accordance with the prior art comprising the antenna structure 2 cut from sheet metal and shaped by bending above an electrically conductive base surface 6;

FIG. 2: a proposal for a shape-defined fixing of the antenna structure 2 in the protective antenna cover 1*a* by surrounding guide grooves 9 and adjustment punches 16 shaped in the interior of the protective antenna cover 1*a* (FIG. 3). A sharp punch burr on the lower/inner side of the sheet metal facilitates the insertion of the vertical radiators 4*a*-4*d* designed as sheet metal "legs" into the guide. The electrode angle 14 produced from the prefabrication is set to approximately 87° in the example and the bend angle of the vertical radiators 15 with respect to the plane of the loop structure 3 is likewise set to approximately 87°. The two angles are brought to the final angle of 90° by introduction of the antenna structure 2 into the protective antenna cover 1*a* with the aid of the method of adjustment shown in FIG. 2;

FIG. 3: fixing the antenna structure 2 in the protective antenna cover 1*a* in accordance with the invention by guiding the slightly projecting vertical radiators 4*a*-4*d* in the vertically extending guide grooves 9 and fixing the capacitive flat electrodes 7 by holding them down with the aid of adjustment punches 16. The adjustment punch 16 as part of the inner shape of the protective antenna cover 1*a* pressed from plastic is provided with two abutments 17, 18 of which the upper abutment 17 holds down the loop structure 3 and the lower abutment 18 presses down the capacitive flat electrode 7 in a manner such that its parallelism with the electrically conductive base surface 6 is set. The required spacing 11 is observed exactly via the spacing end seated on the conductive base surface 6. This effect is achieved by the length of the adjustment punch 16 at its lower end by pressing onto an electrically conductive surface 6, not shown. The antenna structure 2 is mechanically preloaded due to the sheet metal resilience and is completely stable in the long term after insertion into the protective antenna cover 1*a* by the presetting described under FIG. 2 of the bend angle of the vertical radiators 15 and of the electrode angle 14 to 87°;

FIG. 4: a representation of an antenna arrangement 0 in accordance with the invention on a vehicle roof in a side view as a section in the plane of the direction of travel. The protective antenna cover 1*a* (ESD cover) is attached as an electrically conductive base surface 6 above a circuit board. The example shows an embodiment of the adjustment punch 16 with the abutments 17 and 18 and the shape of the guide of the antenna structure 2 in the interior of the protective antenna cover 1*a* by the two laterally marked guide furrows 9. In this advantageous embodiment of the invention, a space 19 remains at the center of the interior of the protective antenna cover 1*a* for vertical antennas that can, for example, preferably be designed in circuit board technology;

FIG. 5: a representation of an antenna arrangement 0 in accordance with the invention on a vehicle roof in a plan view of a horizontal section. An exemplary embodiment of the design of the interior of the protective antenna cover 1*a* with adjustment punches 16 for holding down the loop structure 3 and for the fixing of its height 20 (FIG. 3) and for the adjustment of the capacitive flat electrodes 7*a*-7*d*. This illustration also shows, as described above, that there is a space 19 for vertical antennas at the center of the interior of the protective antenna cover 1*a;*

Figure 6:
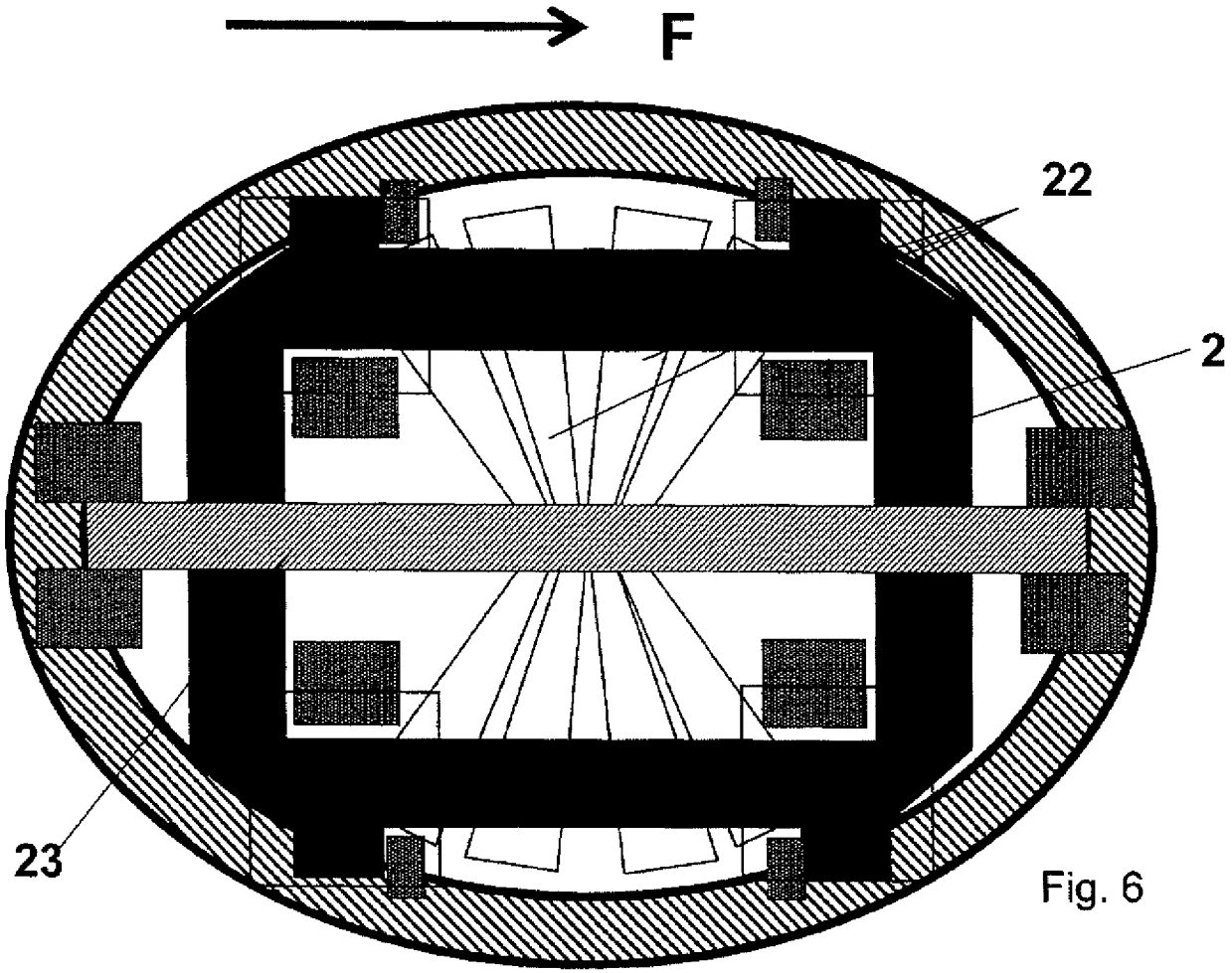
Figure 7:
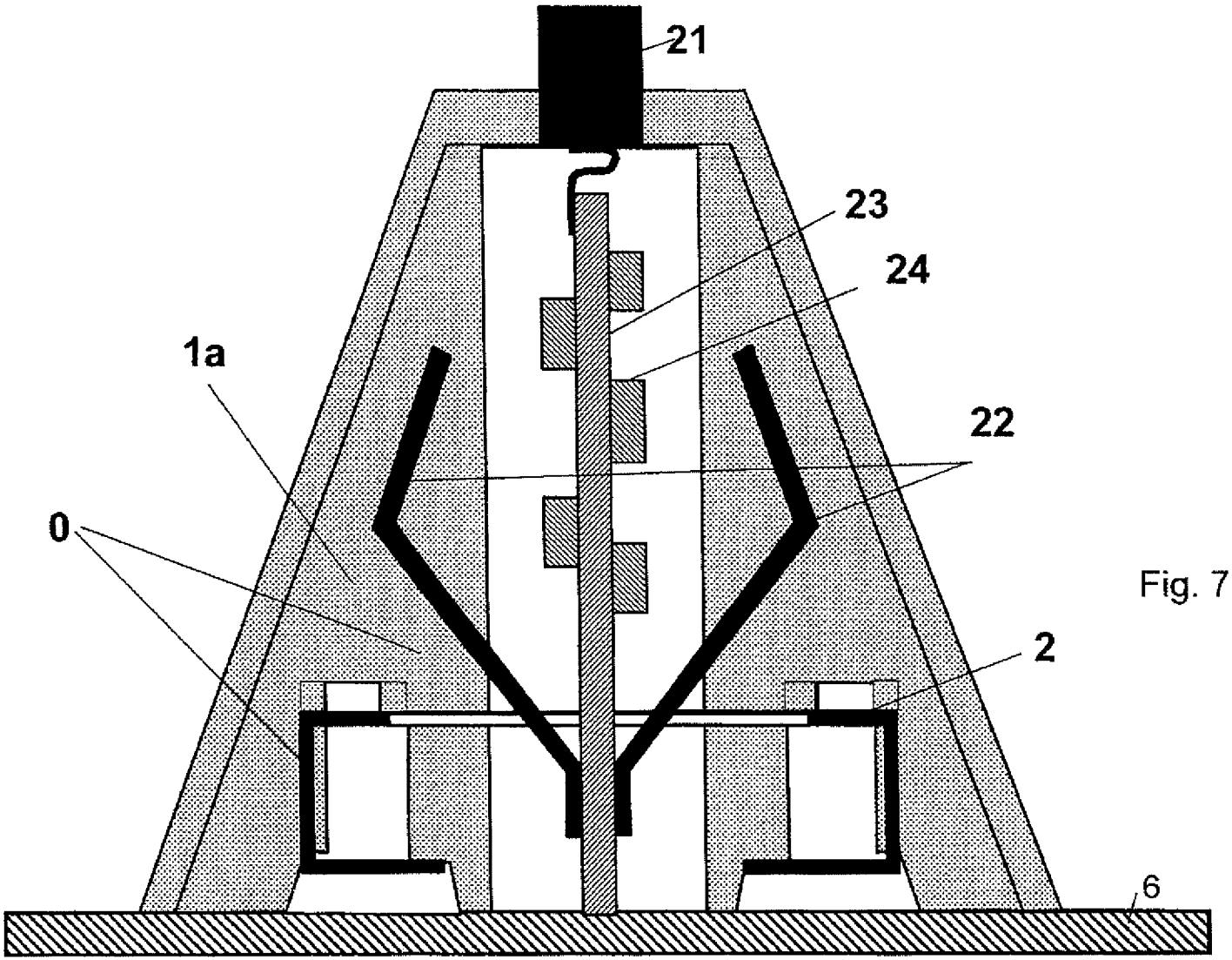

FIG. 6: shows the one antenna circuit board 23 as a support for electrical circuit structures and the components of a terrestrial antenna. It is arranged in a vertical plane in the direction of travel F. Circuit structures for a terrestrial telephone antenna 24 (FIG. 7) can, for example, be printed in this manner electromagnetically decoupled from the satellite antenna. Fan-like circuit strips that are angled in V shape in a plane transversely to the direction of travel F are applied to both sides of the circuit board to form a terrestrial broadband communication antenna 22—e.g. for LTE;

FIG. 7: a section in a side view in a vertical plane transversely to the direction of travel F. The fan-like circuit strips of the terrestrial broadband communication antenna 22 are connected to the antenna circuit board 23 by which the terrestrial telephone antenna 24 is also formed.

Furthermore, a rod-shaped terrestrial antenna 21 (for example for AM/FM/DAB, etc.) is attached above the protective antenna cover 1 to form a terrestrial antenna for lower frequencies in the continuation of the vertical central line of the loop radiator 1 and is mechanically connected to the protective antenna cover 1*a* and is electrically connected to the antenna circuit board 23.

Advantageous Embodiments of the Invention are Shown again in the Following:

1. An antenna arrangement (0) for the reception of circularly polarized satellite radio signals in which an antenna structure (2) having a loop radiator (1) is arranged in a protective antenna cover (1*a*) of plastic, wherein the protective antenna cover (1*a*) is provided at an inner side with grooves (9) that are open toward the opening and that are adapted to the outer contour of the antenna structure (2) such that it is held with shape matching at least in the peripheral direction in the protective antenna cover (1*a*) after an insertion through the opening.
2. An antenna arrangement (0) in accordance with example 1, characterized in that
   at least one abutment (17, 18) which the antenna structure (2) abuts when it is fully pushed into the protective antenna cover (1*a*) is provided in the protective antenna cover (1*a*).
3. An antenna arrangement (0) in accordance with example 1 or example 2, characterized in that
   a latch element (26) that fixes the antenna structure (2) in the completely inserted position in the protective antenna cover (1*a*) is provided in the protective antenna cover (1*a*).
4. An antenna arrangement (0) in accordance with at least one of the preceding examples,
   characterized in that the positions of the guide grooves (9) are adapted to the dimensions of the loop structure (3) and their width is adapted to the width of the sheet metal strips forming the vertical radiators (4*a*-4*d*) by which the vertical radiators (4*a*-4*d*) are guided in an exact shape on the insertion of the antenna structure (2) into these guide grooves (9).
5. An antenna arrangement (0) in accordance with at least one of the preceding examples,
   characterized in that
   the antenna structure (2) is a bent sheet metal part that has a closed loop structure (3) which forms the loop radiator (1) and at whose periphery at least three sheet metal strips (4*a*-*d*) facing away from the loop structure (3) are formed to design vertical radiators (4*a*-*d*) whose ends are each formed as capacitive flat electrodes (7*a*-7*d*).
6. An antenna arrangement (0) in accordance with example 5,
   characterized in that
   the sheet metal strips (4*a*-4*d*) are bent by a bend angle (15) of approximately 90° out of the plane of the loop structure (3), in that the capacitive flat electrodes (7*a*-7*d*) are bent by the electrode angle (14) of approximately 90° with respect to the sheet metal strip, and in that the capacitive flat electrodes (7*a*-7*d*) extend at a spacing (11) almost in parallel with the plane of the loop structure (3).
7. An antenna arrangement (0) in accordance with example 5 or example 6,
   characterized in that
   the vertical radiators are bent by a bend angle (15) out of the plane of the loop structure (3) to generate a preload, said bend angle (15) being set up to a few angular degrees smaller than 90° so that the vertical radiators (4*a*-4*d*) are held under preload in the grooves after inserting the antenna structure (2) into the protective antenna cover (1*a*) when the antenna structure (2) is completely inserted into the protective antenna cover (1*a*).

8. An antenna arrangement (0) in accordance with at least one of the preceding examples 2-7,
characterized in that
the loop radiator (1) or the loop structure (3) abuts the abutment (17).

9. An antenna arrangement (0) in accordance with at least one of the preceding examples 5-8,
characterized in that
at least one abutment (18) is provided in the protective antenna cover (1*a*) which the capacitive flat electrodes (7*a*-7*d*) abut when the antenna structure (2) is completely inserted into the protective antenna cover (1*a*).

10. An antenna arrangement (0) in accordance with example 9,
characterized in that
the capacitive flat electrodes (7*a*-7*d*) are bent with respect to the vertical radiators (4*a*-4*d*) by an electrode angle (14) to generate a preload, said electrode angle (14) being set up to a few angular degrees smaller than 90° so that the capacitive flat electrodes (7*a*-7*d*) contact the abutment (18) at a preload after inserting the antenna structure (2) into the protective antenna cover (1*a*) when the antenna structure (2) is completely inserted into the protective antenna cover (1*a*).

11. An antenna arrangement (0) in accordance with at least one of the preceding examples,
characterized in that
a space (19) for vertical antennas is provided at the center of the loop radiator (1) in the interior of the protective antenna cover (1*a*) and at least one vertical antenna (21, 22, 24) for terrestrial radio services is arranged in said space (19).

12. An antenna arrangement (0) in accordance with example 11,
characterized in that
an antenna circuit board (23) is present for the formation of vertically polarized antennas for terrestrial radio services in the space (19), said antenna circuit board (23) being designed as a support of electrical circuit structures and of components of a terrestrial antenna and being held in guide grooves that are formed in the interior of the protective antenna cover (1*a*).

13. An antenna arrangement (0) in accordance with example 12,
characterized in that
fan-like conductor strips that are angled in V shape in a plane are attached to both sides of the circuit board (23) to form a terrestrial broadband communication antenna (22).

14. An antenna arrangement (0) in accordance with one of the examples 12 to 13,
characterized in that
a rod-shaped terrestrial antenna (21) that is mechanically connected to the protective antenna cover (1) and electrically connected to the antenna circuit board (23) is attached above the protective antenna cover (1*a*) in the continuation of a vertical central line of the loop radiator (1) to form a terrestrial antenna for lower frequencies.

15. An antenna arrangement (0) in accordance with any one of the examples 12 to 14,
characterized in that
a common terrestrial antenna connection is formed at the lower end of the antenna circuit board (23) for all present terrestrial antennas.

16. An antenna arrangement (0) in accordance with at least one of the preceding examples,
characterized in that
the connection of the antenna structure (2) to an antenna connector (10) is established without a solder connection.

REFERENCE NUMERAL LIST

0 antenna arrangement
1 loop radiator
1*a* protective antenna cover
2 antenna structure
3 loop structure
4*a*-*d* vertical radiators
5*a*-5*d* capacitor
6 electrically conductive base surface
7*a*-7*d* capacitive flat electrodes
8 vertical radiators
9 vertically extending guide grooves 9
10 antenna connector
11 opening margin
12 overhang
13 sharp punch burr
14 electrode angle
15 bend angle of the vertical radiators
16 adjustment punch
17 upper abutment
18 lower abutment
19 space for vertical antennas
20 height
21 rod shaped terrestrial antenna
22 terrestrial broadband communication antenna
23 antenna circuit board
24 terrestrial telephone antenna
25 counter-electrode
26 latch nose

The invention claimed is:

1. An antenna arrangement for the reception of circularly polarized satellite radio signals in which antenna arrangement an antenna structure having a loop radiator is arranged in a protective antenna cover of plastic, the protective antenna cover having an opening, wherein the protective antenna cover is provided at the inner side with grooves that are open toward the opening and that are adapted to an outer contour of the antenna structure such that it is held with shape matching at least in a peripheral direction in the protective antenna cover after an insertion through the opening.

2. The antenna arrangement in accordance with claim 1, wherein at least one abutment which the antenna structure abuts when it is fully pushed into the protective antenna cover is provided in the protective antenna cover.

3. The antenna arrangement in accordance with claim 1, wherein a latch element that fixes the antenna structure in the completely inserted position in the protective antenna cover is provided in the protective antenna cover.

4. The antenna arrangement in accordance with claim 1, wherein positions of the guide grooves are adapted to dimensions of the loop structure and a width of the guide grooves is adapted to a width of sheet metal strips forming vertical radiators by which the vertical radiators are guided in an exact shape on the insertion of the antenna structure into these guide grooves.

5. The antenna arrangement in accordance with claim 1, wherein the antenna structure is a bent sheet metal part that has a closed loop structure which forms the loop radiator and at whose periphery at least three sheet metal strips facing away from the loop structure are formed to design vertical radiators whose ends are each formed as capacitive flat electrodes.

6. The antenna arrangement in accordance with claim 5, wherein the sheet metal strips are bent by a bend angle of approximately 90° out of the plane of the loop structure, wherein the capacitive flat electrodes are bent by the electrode angle of approximately 90° with respect to the sheet metal strip, and wherein the capacitive flat electrodes extend at a spacing almost in parallel with the plane of the loop structure.

7. The antenna arrangement in accordance with claim 5, wherein the vertical radiators are bent by a bend angle out of the plane of the loop structure to generate a preload, said bend angle being set up to a few angular degrees smaller than 90° so that the vertical radiators are held under preload in the grooves after inserting the antenna structure into the protective antenna cover when the antenna structure is completely inserted into the protective antenna cover.

8. The antenna arrangement in accordance with claim 2, wherein the loop radiator abuts the abutment.

9. The antenna arrangement in accordance with claim 5, wherein at least one abutment is provided in the protective antenna cover which the capacitive flat electrodes abut when the antenna structure is completely inserted into the protective antenna cover.

10. The antenna arrangement in accordance with claim 9, wherein the capacitive flat electrodes are bent with respect to the vertical radiators by an electrode angle to generate a preload, said electrode angle being set up to a few angular degrees smaller than 90° so that the capacitive flat electrodes contact the abutment at a preload after inserting the antenna structure into the protective antenna cover when the antenna structure is completely inserted into the protective antenna cover.

11. The antenna arrangement in accordance with claim 1, wherein a space for vertical antennas is provided at the center of the loop radiator in the interior of the protective antenna cover and at least one vertical antenna for terrestrial radio services is arranged in said space.

12. The antenna arrangement in accordance with claim 11, wherein an antenna circuit board is present for the formation of vertically polarized antennas for terrestrial radio services in the space, said antenna circuit board being designed as a support of electrical circuit structures and of components of a terrestrial antenna and being held in guide grooves that are formed in the interior of the protective antenna cover.

13. The antenna arrangement in accordance with claim 12, wherein fan-like conductor strips that are angled in V shape in a plane are attached to both sides of the circuit board to form a terrestrial broadband communication antenna.

14. The antenna arrangement in accordance with claim 12, wherein a rod-shaped terrestrial antenna that is mechanically connected to the protective antenna cover and is electrically connected to the antenna circuit board is attached above the protective antenna cover in a continuation of a vertical central line of the loop radiator to form a terrestrial antenna for lower frequencies.

15. The antenna arrangement in accordance with claim 12, wherein a common terrestrial antenna connection is formed at the lower end of the antenna circuit board for all present terrestrial antennas.

16. The antenna arrangement in accordance with claim 1, wherein the connection of the antenna structure to an antenna connector is established without a solder connection.

* * * * *